US012746595B1

(12) United States Patent
Belley et al.

(10) Patent No.: US 12,746,595 B1
(45) Date of Patent: Sep. 29, 2026

(54) ASSEMBLY FOR DEGASSING ALUMINUM

(71) Applicant: STAS Inc., Chicoutimi (CA)

(72) Inventors: Guy Belley, Saguenay (CA); Vincent Milani, Jonquière (CA); Sylvain Tremblay, Chicoutimi (CA)

(73) Assignee: Stas Inc., Chicoutimi (CA)

( * ) Notice: Subject to any disclaimer, the term of this patent is extended or adjusted under 35 U.S.C. 154(b) by 0 days.

(21) Appl. No.: 19/325,073

(22) Filed: Sep. 10, 2025

(51) Int. Cl.
*B22D 45/00* (2006.01)
*B22D 41/01* (2006.01)
*B22D 41/04* (2006.01)

(52) U.S. Cl.
CPC ..... *B22D 45/005* (2013.01); *B22D 41/01* (2013.01); *B22D 41/04* (2013.01)

(58) Field of Classification Search
CPC ..... B22D 45/005; B22D 41/01; B22D 41/04
USPC ..... 266/233
See application file for complete search history.

(56) References Cited

U.S. PATENT DOCUMENTS 1,948,835 A 2/1934 Alvord
3,839,019 A 10/1974 Bruno
4,443,004 A 4/1984 Hicter
4,531,717 A * 7/1985 Hebrant ..... B22D 35/04 266/166
5,435,528 A 7/1995 Guttery et al.
5,527,381 A 6/1996 Waite
5,660,614 A 8/1997 Waite
6,887,424 B2 5/2005 Ohno
7,785,394 B2 8/2010 Chesonis
8,025,712 B2 * 9/2011 Dupuis ..... C22B 21/062 75/708
8,657,164 B2 * 2/2014 Reeves ..... F27D 1/0009 266/196
9,073,119 B2 * 7/2015 Tremblay ..... B22D 41/005
10,233,515 B1 3/2019 Rundquist et al.
(Continued)

FOREIGN PATENT DOCUMENTS

CN 103173629 6/2013
CN 105112687 12/2015
(Continued)

OTHER PUBLICATIONS

S. Lavoie, E. Pilote, M.A. Thibault, and J.P. Pomerleau, "The Alcan Compact Degasser, A Trough-Based Aluminum Treatment Process. Part II : Equipment Description and Plant Experience", (Light Metals 1996).

(Continued)

*Primary Examiner* — Jessee R Roe
*Assistant Examiner* — Michael Aboagye
(74) *Attorney, Agent, or Firm* — Decode Legal Inc.; Mathieu Audet

(57) ABSTRACT

A trough assembly for degassing molten aluminum. The trough assembly comprises a trough adapted for a stream of molten aluminum to flow trough. The trough comprises a central section in which the stream slows down. Removable agitators are adapted to be inserted in the central section of the trough, and used to degassing the molten aluminum. The trough is tiltable to be emptied. In the stream flowing position, the trough is laid over a heating bed to ensure that the aluminum remains liquid. The trough may be equipped with a flexible extension adapted to remain secured thereto when emptying the trough.

17 Claims, 10 Drawing Sheets

(56) References Cited

U.S. PATENT DOCUMENTS

| | | | | |
|---|---|---|---|---|
| 10,408,540 | B2 * | 9/2019 | OFallon | B22D 45/00 |
| 2008/0030792 | A1 | 2/2008 | Shiiyama | |
| 2008/0163999 | A1 | 7/2008 | Hymas | |
| 2009/0229415 | A1 | 9/2009 | Frank et al. | |
| 2013/0334744 | A1 | 12/2013 | Tremblay et al. | |
| 2023/0212711 | A1 | 7/2023 | Tremblay et al. | |

FOREIGN PATENT DOCUMENTS

| | | |
|---|---|---|
| CN | 206747556 | 12/2017 |
| CN | 216404498 | 4/2022 |
| CN | 117778732 | 3/2024 |
| CN | 220591512 | 3/2024 |

OTHER PUBLICATIONS

M.B. Taylor and B. Maltais, "Experience With the Sealed Alcan Compact Degasser (ACD)," Aluminium Cast House Technology 2005, ed. J.A. Taylor, I.F. Bainbridge and J.F. Granfield (9th Australasian Conference and Exhibition, 2005), 221-229.

Waite, P. and Thiffault, R. (2013). The Alcan Compact Degasser: A Trough-based Aluminum 1 Treatment Process. Part I: Metallurgical Principles and Performance. In Essential Readings in Light Metals (eds J.F. Grandfield and D.G. Eskin). https://doi.org/10.1002/9781118647783.ch28.

STAS Inc.; ACD Aluminium Compact Degasser brochure; 2023; https://www.stas.com/wp- 1, 2, 10, 11, 17-20content/uploads/2018/08/brochure-acd 2023v01-en.pdf.

* cited by examiner

ASSEMBLY FOR DEGASSING ALUMINUM

CROSS-REFERENCE US/PCT

This application claims priority to, or benefit of, provisional application U.S. 69/693,455, filed Sep. 11, 2024, entitled ASSEMBLY FOR DEGASSING ALUMINUM, the specification of which is hereby incorporated herein by reference in its entirety.

BACKGROUND

(A) Field

The subject matter disclosed relates to apparatus used for conveying molten metals during degassing process and alike. More particularly, the invention relates to apparatus for and methods of conveying molten metals and performing operations of degassing over the molten metal when conveyed.

(b) Related Prior Art

It is common practice during metal casting operations to cause a molten metal to flow through an elongated trough (sometimes called a launder), for example from a melting furnace to a casting mold. Such troughs are made of a material that can resist exposure to the molten metal for a reasonable duration without undue damage, and the conditions must be such that the metal does not cool below its freezing temperature (solidus) before it reaches its destination. When troughs of this kind are short, fast-flowing (e.g. relatively steeply inclined) or of relatively small metal-holding capacity, there is little risk of metal freezing. Over the years, however, various new practices have made it necessary to provide troughs of greater capacity, greater length and/or slower flow, particularly in the aluminum treatment arts. For example, U.S. Pat. No. 5,527,381 to Peter D. Waite, et al., which issued on Jun. 18, 1996, discloses a degassing method of treating a molten metal with a gas to remove dissolved hydrogen and other impurities as the metal flows through a trough or launder. The treatment can be made more thorough if the trough is of large metal-holding capacity and the metal is caused to flow at a slow rate of throughput.

Additionally, molten metal is sometimes filtered through ceramic foam filters to remove solid particles, and the use of such filters may slow the flow of molten metal through a trough. Consequently, in applications such as these and others, the risk of metal solidification (or undue cooling) in the trough is increased.

In view of the challenges of treatment of molten metal, and particularly of molten aluminum, especially regarding ideal conveying flow of material varying with the process to be performed and lifespan of the components involved, improvements are sought after.

SUMMARY

According to an embodiment, there is provided a novel assembly for degassing molten aluminum.

In some aspects, the description herein relates to a trough assembly for degassing molten aluminum, including: a trough having a passage extending from an upstream end to a downstream end, the passage being adapted for a stream of the molten aluminum to be conveyed thereby, the passage having a central section in-between the upstream end and the downstream end adapted to slow down the stream, means for heating the central section of the trough; and a plurality of agitators movable between i) an elevated position in which they are adapted to be distant from the stream and ii) a lowered position in which the agitators are adapted to extend across the stream.

In some aspects, the description herein relates to a trough assembly, further including a first driving component for raising and lowering the agitators, a second driving component for actuating the agitators, and a third driving component for injecting solid, liquid or gaseous additive into the stream through the agitators.

In some aspects, the description herein relates to a trough assembly, wherein the trough includes pinions extending outwardly about a first one of the ends thereof, the trough being tiltable around the pinions when raising a second one of the ends thereof.

In some aspects, the description herein relates to a trough assembly, wherein, in a first position in which the stream flows, the passage deepens from the upstream end to the central section.

In some aspects, the description herein relates to a trough assembly, wherein the trough is movable between a first position adapted for the stream to flow through and a second position adapted to empty the trough in which a first one of the ends of the trough is raised relative to a second one of the ends of the trough, wherein the trough is exerted a rotation of at least 10 degrees between its first position and its second position.

In some aspects, the description herein relates to a trough assembly, wherein the trough has a floor that, in the first position, has a slope that reaches an angle of at most 15 degrees between the central section and the downstream end thereof.

In some aspects, the description herein relates to a trough assembly, wherein, in a first position in which the stream flows, the passage widens from the upstream end to the central section.

In some aspects, the description herein relates to a trough assembly, wherein, in a first position in which the stream flows, the passage shallows from the central section to the downstream end.

In some aspects, the description herein relates to a trough assembly, wherein, in a first position in which the stream flows, the passage narrows from the upstream end to the central section.

In some aspects, the description herein relates to a trough assembly, wherein the means for heating the trough includes a heating bed on which is adapted to be laid the trough.

In some aspects, the description herein relates to a trough assembly, wherein the heating bed includes refractory material with electric heating elements set therein, wherein the trough and the heating bed have marrying shape adapted for optimizing contact between the trough and the heating bed.

In some aspects, the description herein relates to a trough assembly, further including a deformable trough extension.

In some aspects, the description herein relates to a trough assembly, wherein the trough extension includes two ends with one end of the trough extension being secured to one end of the trough, and the second one of the two ends of the trough extension adapted to be fixedly secured to another device.

In some aspects, the description herein relates to a trough assembly, wherein the trough extension includes a pair of rigid flanges, and a textile-composed bridge joining the rigid flanges.

In some aspects, the description herein relates to a trough assembly, wherein the trough is movable between a first position adapted for the stream to flow through and a second position adapted to empty the trough in which a first one of the ends of the trough is raised relative to a second one of the ends of the trough, wherein the bridge of the trough extension includes two edges, wherein the edges thereof between the flanges are adapted to move away from one another as the trough is moved in the second position.

In some aspects, the description herein relates to a trough assembly, wherein the bridge of the trough extension includes a first layer made of refractory textile, a second layer made of an insulating layer, and a third layer being mechanically more resistant than the first layer.

In some aspects, the description herein relates to a trough assembly, wherein the trough includes at least one removable wall adapted for releasably sequestering the molten aluminum in the central section thereof.

In some aspects, the description herein relates to a trough assembly, wherein the trough includes a central longitudinal axis, wherein the agitators are aligned with and distributed along the central longitudinal axis in the central section of the trough.

In some aspects, the description herein relates to a trough assembly, wherein each one of the agitators has an axis, wherein distances between the axes of any two neighbor ones of the agitators differ from each other from at most 15%.

In some aspects, the description herein relates to a trough assembly, wherein the trough includes side walls delimiting width of the passage, wherein the side walls are no closer than 85% of a reference value, and are no farther than 115% of the reference value, wherein the reference value is determined to be an average distance between any two neighbor ones of the agitators.

Features and advantages of the subject matter hereof will become more apparent in light of the following detailed description of selected embodiments, as illustrated in the accompanying figures. As will be realized, the subject matter disclosed and claimed is capable of modifications in various respects, all without departing from the scope of the claims. Accordingly, the drawings and the description are to be regarded as illustrative in nature and not as restrictive; the full scope of the subject matter is set forth in the claims.

BRIEF DESCRIPTION OF THE DRAWINGS

Further features and advantages of the present disclosure will become apparent from the following detailed description, taken in combination with the appended drawings, in which.

It will be noted that throughout the appended drawings, like features are identified by like reference numerals.

DETAILED DESCRIPTION

Figure 1:
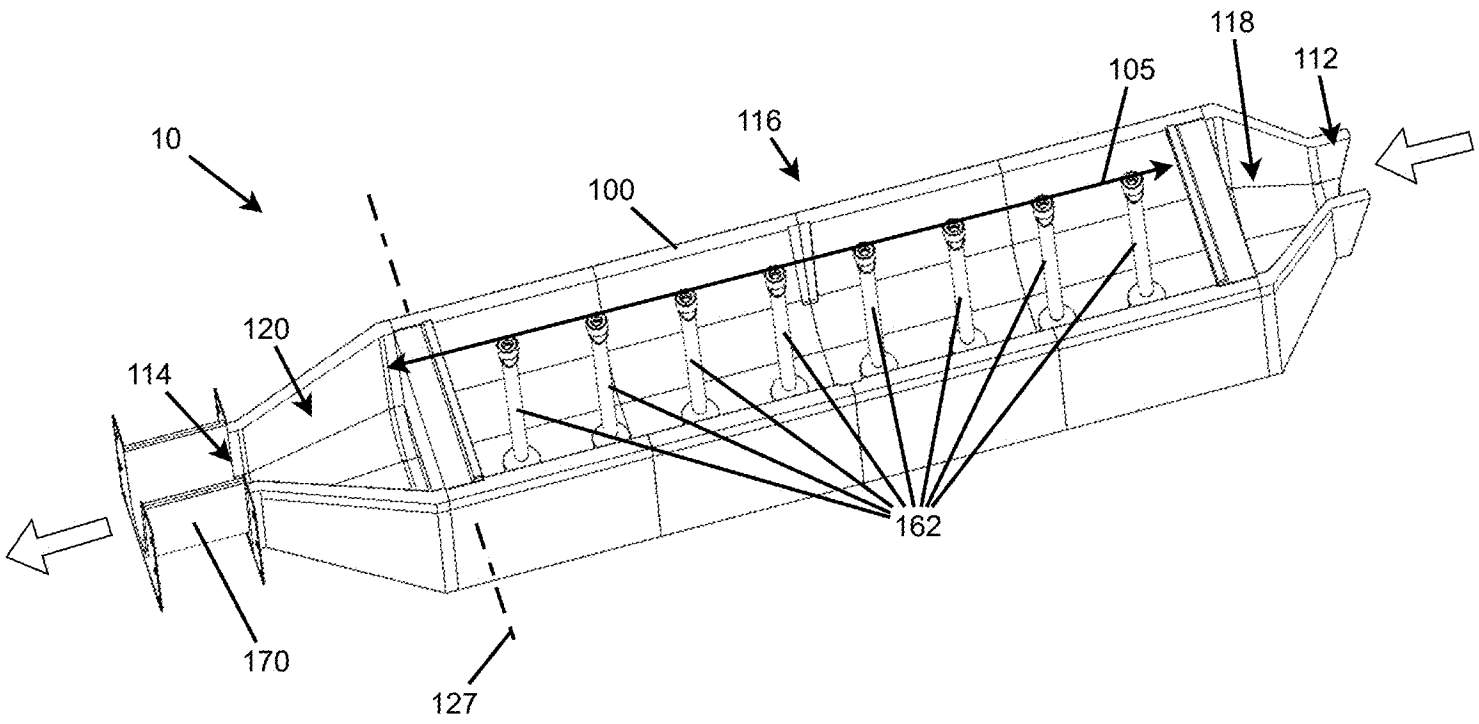
FIG. 1 is a perspective view of a trough assembly in accordance with an embodiment.

Realizations will now be described more fully hereinafter with reference to the accompanying figures, in which realizations are illustrated. The foregoing may, however, be embodied in many different forms and should not be construed as limited to the illustrated realizations set forth herein.

With respect to the present description, references to items in the singular should be understood to include items in the plural, and vice versa, unless explicitly stated otherwise or clear from the text. Grammatical conjunctions are intended to express any and all disjunctive and conjunctive combinations of conjoined clauses, sentences, words, and the like, unless otherwise stated or clear from the context. Thus, the term "or" should generally be understood to mean "and/or" and so forth.

Recitation of ranges of values and of values herein or on the drawings are not intended to be limiting, referring instead individually to any and all values falling within the range, unless otherwise indicated herein, and each separate value within such a range is incorporated into the specification as if it were individually recited herein. The words "about," "approximately," or the like, when accompanying a numerical value, are to be construed as indicating a deviation as would be appreciated by one of ordinary skill in the art to operate satisfactorily for an intended purpose. Ranges of values and/or numeric values are provided herein as examples only, and do not constitute a limitation on the scope of the described realizations. The use of any and all examples, or exemplary language ("e.g.," "such as," or the like) provided herein, is intended merely to better illuminate the exemplary realizations and does not pose a limitation on the scope of the realizations. No language in the specification should be construed as indicating any unclaimed element as essential to the practice of the realizations.

In the following description, it is understood that terms such as "first", "second", "top", "bottom", "above", "below", and the like, are words of convenience and are not to be construed as limiting terms, unless related to gravity effect.

The terms "top", "up", "upper", "bottom", "lower", "down", "vertical", "horizontal", "interior" and "exterior" and the like are intended to be construed in their normal meaning in relation with normal installation of the product.

Referring now to the drawings, and more particularly to FIG. 1, FIGS. 2A-B, FIG. 3, and FIG. 4, a trough assembly 10 comprises a trough 100 that is adapted to be able to process an increased volume of molten aluminum. The trough 100 provides a passage 110 from an upstream end 112 to a downstream end 114. The trough 100 has an irregular shape between the upstream end 112 and the downstream end 114, favoring a flow of higher speed in end parts, namely an upstream section 118 about the upstream end 112 and in a downstream section 120 about the downstream end 114, thus a slower flow in the central section 116.

The upstream section 118 of the passage 110 is shallower and narrower than the central section 116 of the passage 110, increasing its width and depth as it extends toward the central section 116. The floor from the upstream end 112 toward the central section 116 is sloped downward that is leading to the central section 116. The shape of the upstream section 118 thereby favors that most of the molten aluminum does not remain away from the agitators but rather flows toward them.

The central section 116 is designed to provide the room for a degassing process to take place therein, with most of the molten aluminum taking place in the central section 116 of the trough 100. The trough 100 comprises an upstream floor section 154 that has a downward slope, a central floor section 156 that is substantially horizontal, and a downstream floor section 158 having a slightly upwards slope. The downward slope, the horizontal central floor section, and the upward slope of the floor sections are as such defined considering when the trough 100 is in its horizontal position.

The central section 116 is adapted to receive agitators 162 that are movable between i) a tiltable in which they are adapted to be distant from the stream and ii) a lowered position in which the agitators are adapted to extend across the stream. The agitators 162 are adapted to inject additive, e.g., a single gas, a mixture of gas or a gas with a solid flux, and to agitate the molten aluminum when across the stream. The agitators 162 are designed to be lowered in the central section 116 preferably when central section 116 is filled with molten aluminum, and activated therein for the degassing process to take place.

Figure 11:
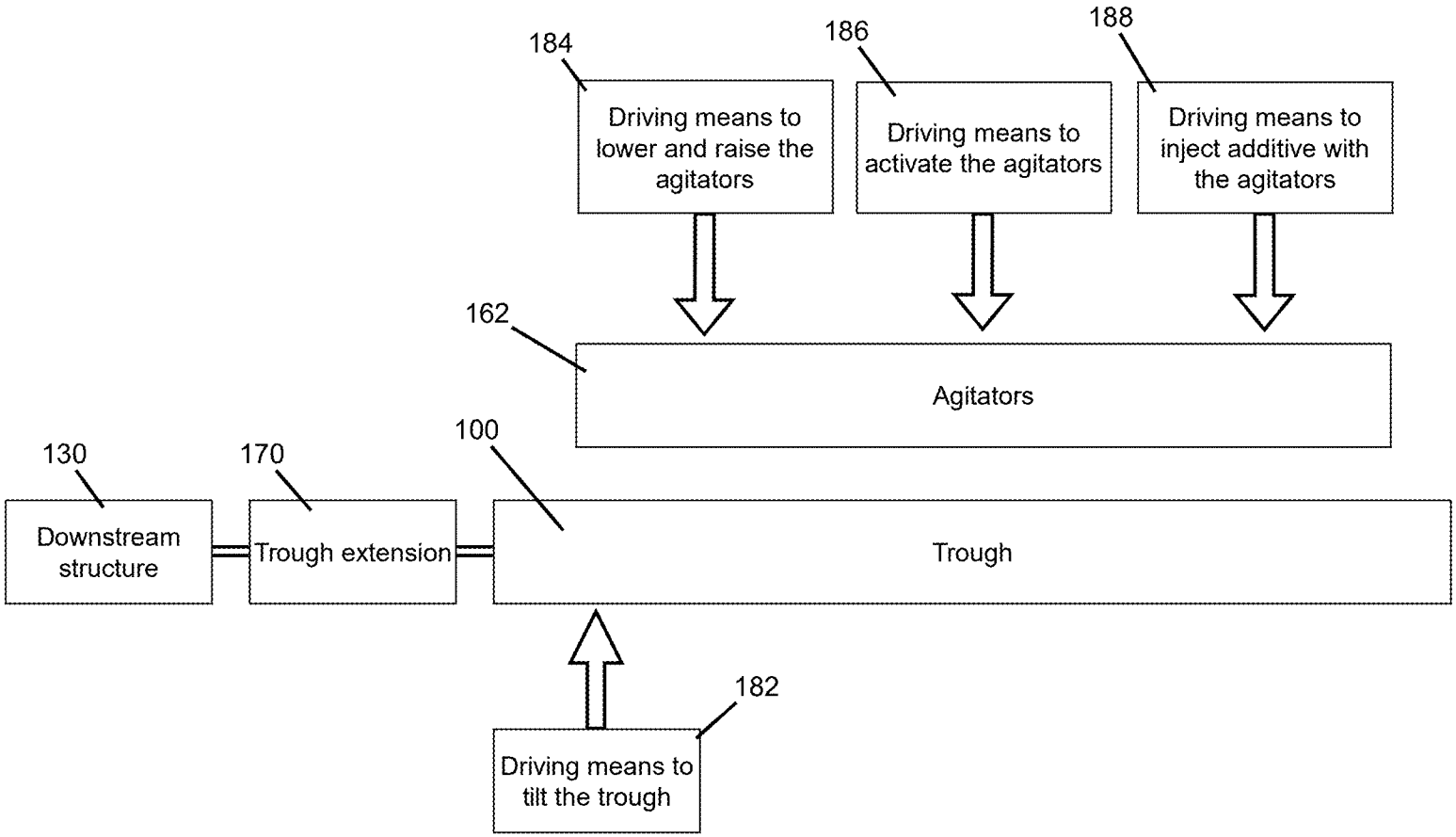
FIG. 11 is a block diagram of a trough assembly and components interacting therewith in accordance with an embodiment.

Accordingly, referring additionally to FIG. 11, three driving components are coupled to the agitators 162, a first driving component 184 adapted to lower/raise the agitators 162, a second driving component 186 adapted to actuate the agitators 162, and a third driving component 188 adapted to control injection of an additive into the molten aluminum through the agitators 162.

According to an embodiment, the number and size of the agitators 162 is set according to the volume of molten aluminum the trough 100 may contain in the central section 116, with the agitators 162 being preferably aligned on a single row along the longitudinal central axis 105 of the trough 100 and evenly distributed along the longitudinal central axis 105.

According to an embodiment, at least a majority of the agitation by the agitators 162 take place in the central section 116 where the speed of the stream of molten metal is the slowest. According to an embodiment, agitators 162 may be located in the upstream floor section 154 in the downstream floor section 158 about the central section 116, wherein the stream is at its almost slowest speed.

According to an embodiment, the agitators 162 are lowered such that their lowest parts thereof are at about the same distance to the part of the floor below thereof (see e.g., FIG. 4), regardless of the slope or absence of slope of the floor at that location.

Figure 2A:
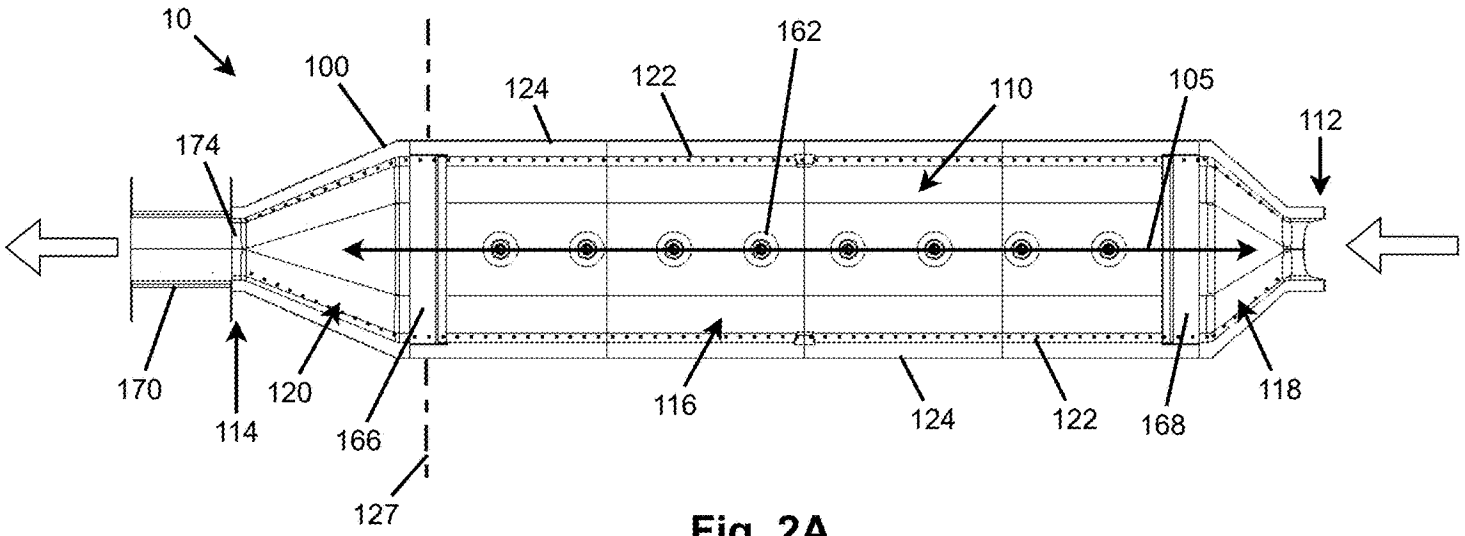
FIG. 2A is a top elevation view of a trough adapted for temporarily sequestering stream with stream retaining walls, with degassing agitators lowered therein, and a trough extension in accordance with an embodiment.
Figure 2B:
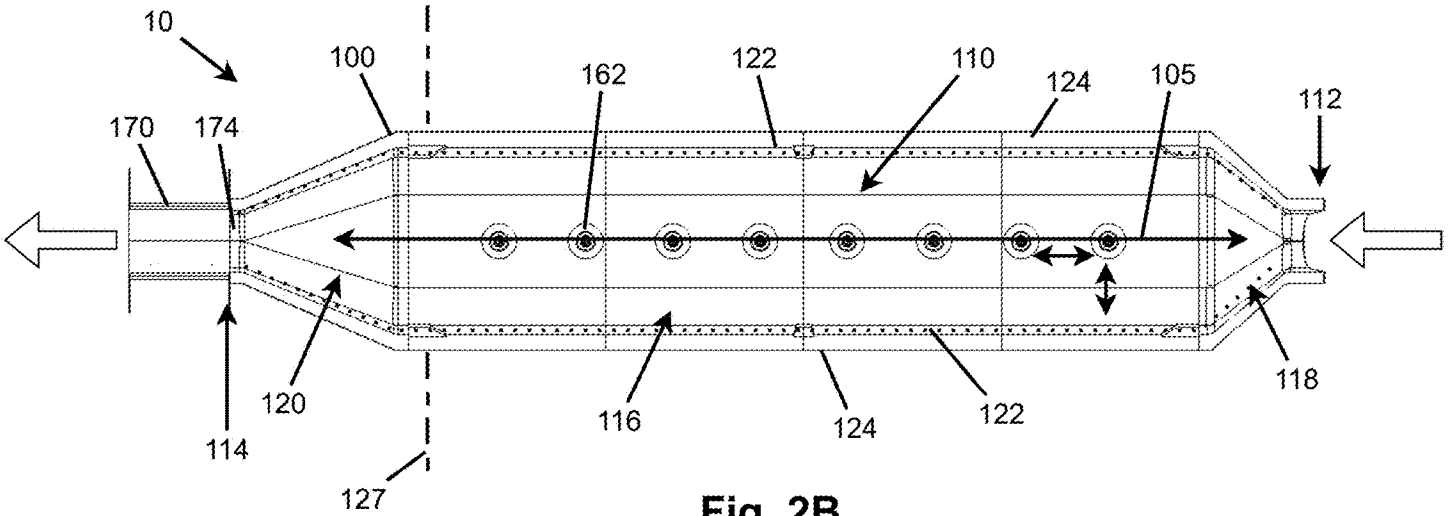
FIG. 2B is a top elevation view of a trough adapted for a continuous stream with degassing agitators lowered therein, and a trough extension in accordance with an embodiment.
Figure 3:
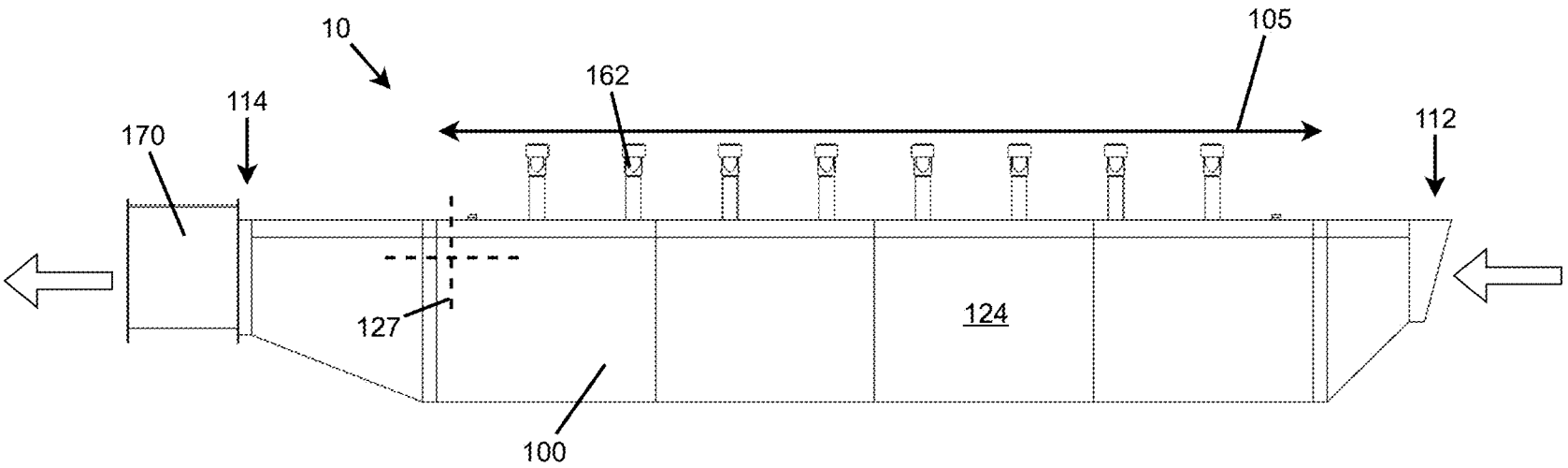
FIG. 3 is a side elevation cross-section view of the trough assembly of FIG. 2B in accordance with an embodiment.

According to an embodiment, the agitators 162 are about equidistant to each other along the longitudinal central axis 105, and at about the same distance (see e.g., FIG. 2B) from each other than from the side walls 124 (see e.g., FIG. 2B). According to embodiments, differences of distances there-between are less than 15%, and preferably less than 10%, and most preferably less than 5% considering distances between axes of neighbor agitators 162. According to embodiments, differences of distances there-between are less than 20%, and preferably less than 15%, and most preferably less than 10% considering the greatest distances between the axes of two neighbor agitators 162 compared to the greatest distance between any agitator 162 and the distance of the part of the side wall 124 that is the closest thereof.

The downstream section 120, about the downstream end 114, is characterized in being having a floor 174 that is raised relative to the lowermost part of the central section 116, gradually shallowing the passage. Furthermore, the side walls 124 are gradually getting closer, narrowing the passage 100 between the central section 116 and the downstream end 114. Therethrough, the speed of the stream of molten aluminum is gradually increased compared to its speed in the central section 116.

It is to be noted that, according to an embodiment, the trough 100 may comprise a downstream wall 166 that divides the downstream section 120 from the central section 116. That downstream wall 166 is closable using a plug (not depicted) to be placed about the floor at the junction of the central section 116 and the downstream section 120. Accordingly, according to that embodiment, during degassing process, the molten aluminum may be temporarily sequestered in the central section 116, and being freed to flow in the downstream section 120 only when ready to empty the trough 100.

According to an embodiment, an upstream wall 168 may also be present, dividing the trough 100 between the upstream section 118 and the central section 116, leaving an opening at the bottom near the floor. The opening may be closed with a plug (not depicted). Accordingly, when filling the trough 100, the trough 100 may be tipped up such as all the molten aluminum flowing in the central section 116, at which stage the plug is placed to close the central section 116.

Furthermore, by controlling when to place plugs, and when to remove the plugs, and when to tip up the trough 100, the molten aluminum may be kept immobile for the degassing process. Furthermore, according to an embodiment, the central section 116 may be heated to keep the molten aluminum from solidifying in that section where the stream is slower or stopped.

According to an embodiment, the trough 100 has a periphery 122 provided by the side walls 124 that delimits the passage 110. The side walls 124 are more elevated than the maximum processing level of molten aluminum.

According to an embodiment, the maximum level is considered for the degassing process, and for the emptying process of molten aluminum from the upstream section 118 into the central section 116, wherein the maximum is more distant to the floor close to the downstream wall 166 than close to the upstream wall 168.

Referring to FIGS. 1-3 and FIG. 11, the trough 100 is driven, e.g., being mounted at one point on pinions (with pinion axis 127 depicted) and having driving means 182, e.g., hydraulic linear actuators coupled thereto, for the trough 100 to be tilted, or, in other words, to be able to operate in a first position that is a horizontal position adapted for the stream to flow, and a second position that is an emptying position after having stopped a upstream feeding of molten aluminum.

Figure 5:
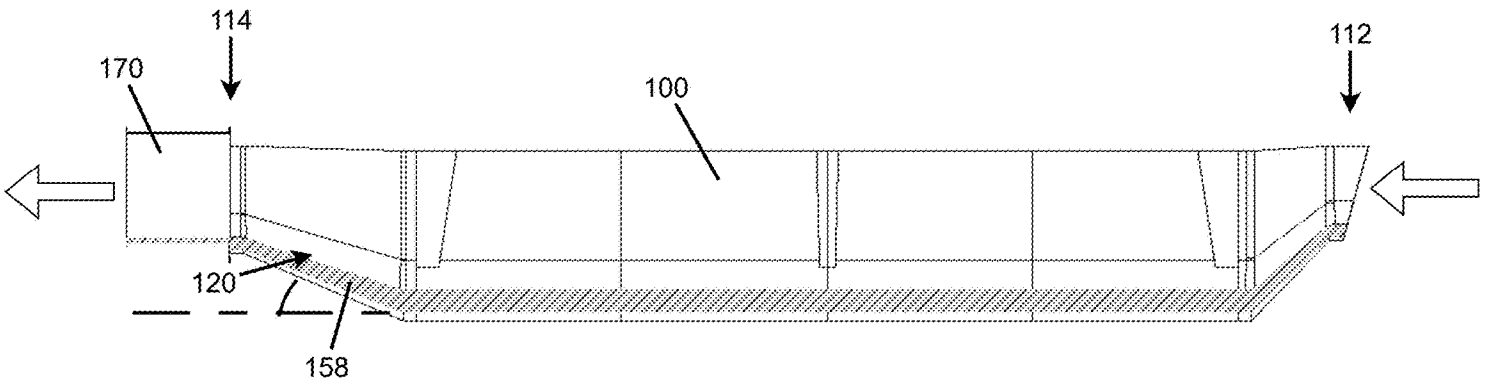
FIG. 5 is a side elevation cross-section view of the trough assembly of FIG. 2B with the agitators elevated out of the stream, hidden in the view, the trough assembly in position for the stream to flow continuously through the trough in accordance with an embodiment.

Referring to the first position (horizontal position or stream-flowing position) depicted in FIG. 5, the trough 100 is extending substantially horizontally.

Figure 6:
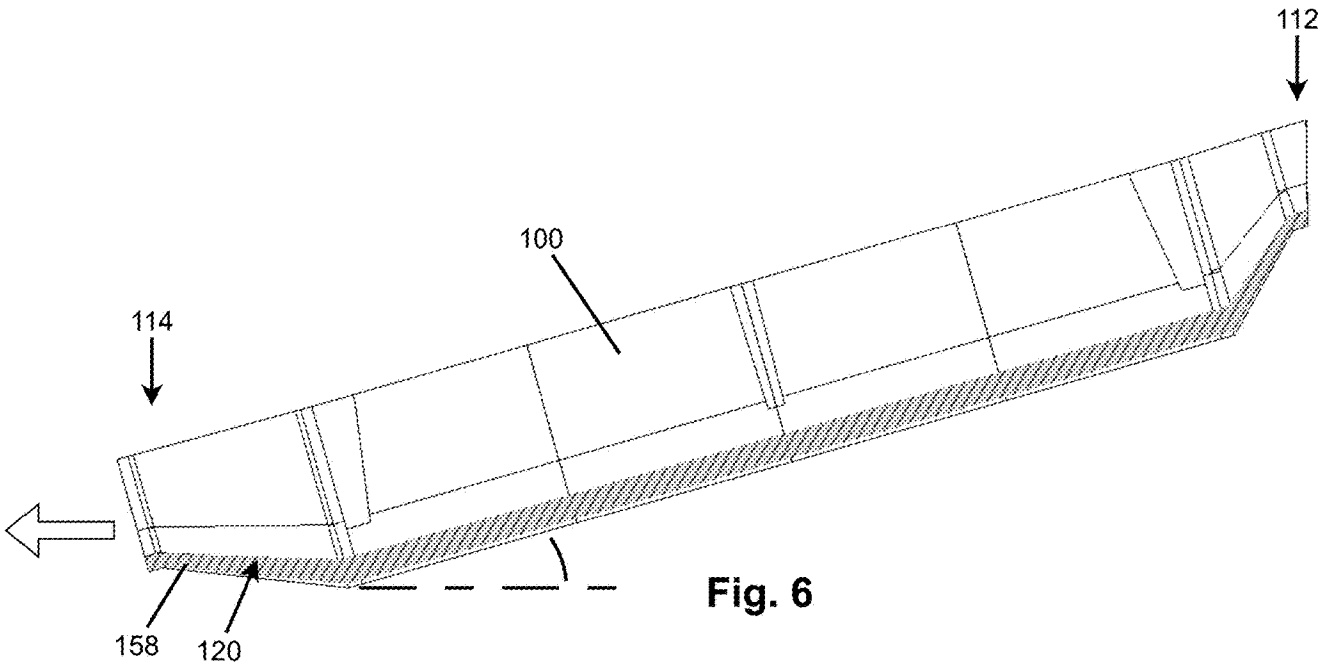
FIG. 6 is a side elevation cross-section view of the trough assembly of FIG. 2B with the agitators elevated out of the stream, hidden in the view, the trough assembly in position for emptying the trough of molten aluminum in accordance with an embodiment.

Referring to the second position (tilted position or emptying position) in which the upstream end 112 is elevated depicted in FIG. 6, that position is used to empty the trough 100. Before the trough 100 being tilted, the agitators 162 are raised above the trough 100, and the trough 100 is afterwards tilted by e.g., extending hydraulic, pneumatic or electric linear actuators. Consequently, the molten aluminum flows towards the downstream end 114 and out of the trough 100.

According to an embodiment, for emptying the trough 100, the trough 100 is tilted slightly over the angle resulting in the downstream floor section 158 exceeding a horizontal position. At that angle, the whole volume of molten aluminum contained in the passage 110 are forced towards the downstream end 114.

In an embodiment, the downstream floor section 158 is upward sloped with an angle of at least 9 degrees, and preferably about 15 degrees when considering the first position of the trough 100, and the tilting angle of the trough 100 is at least 10 degrees, and preferably over 15 degrees.

According to an embodiment, in order to keep the molten aluminum in a liquid state in the trough 100, the trough 100 is laid over a bed 180 in the horizontal position. The bed 180 is heated, heating at least the central section 116 of the trough 100 where the stream is slower during the degassing process when a stream is present.

Figure 8:
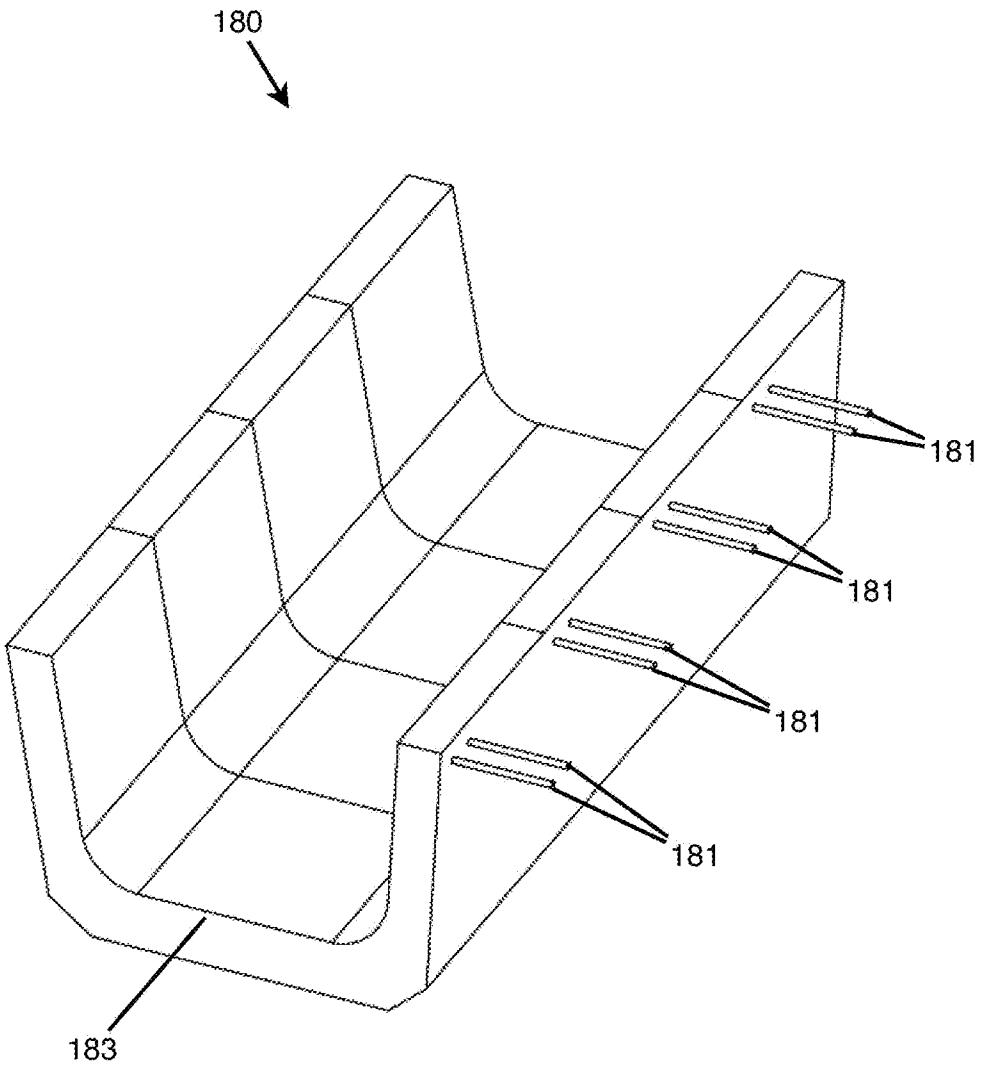
FIG. 8 is a perspective elevation view of a bed for a trough in accordance with an embodiment.

Referring to FIG. 8, the heating bed 180 is made of refractory material 183, with electric heating elements 181 set therein. The heating elements 181 are adapted, when powered, to heat in the refractory material 183, with the heat being transmitted to the molten aluminum through the refractory material 183 and the structure of the trough 100.

The heatingAccording to another embodiment, the heating could also be accomplished by the use of heating panels located outside the refractory liner. The radiation provided by the heating panel is transferred to the refractory by direct contact with it or from a distance greater than 25 mm from the refractory.

Figure 4:
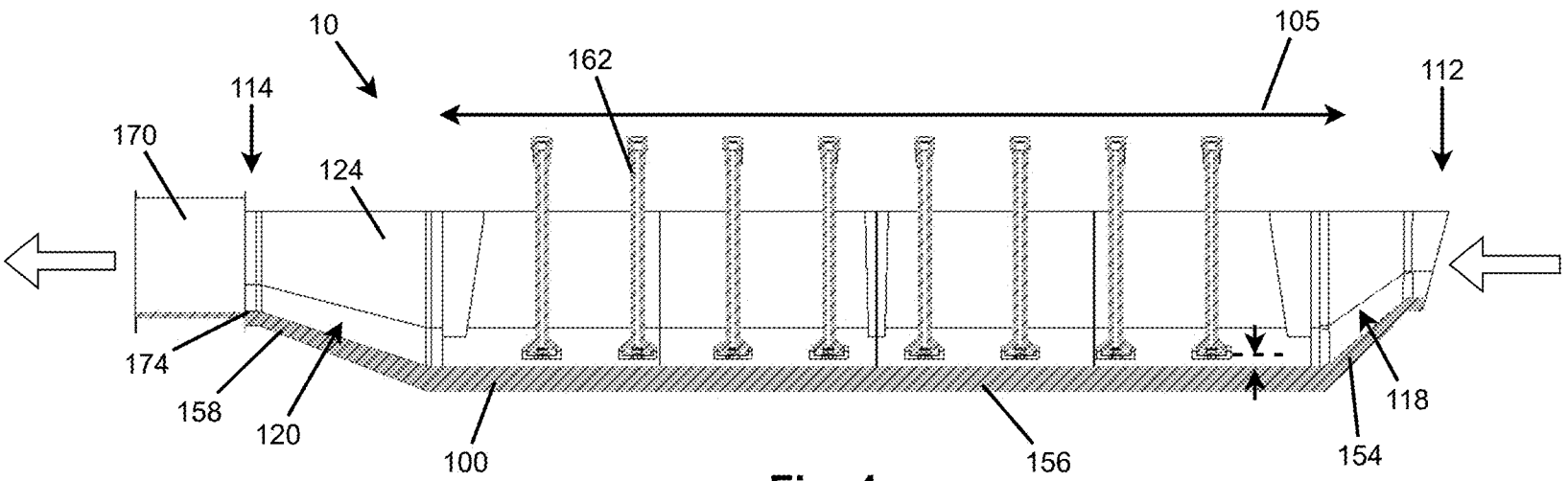
FIG. 4 is a side elevation view of the trough assembly of FIG. 2B in accordance with an embodiment.
Figure 7:
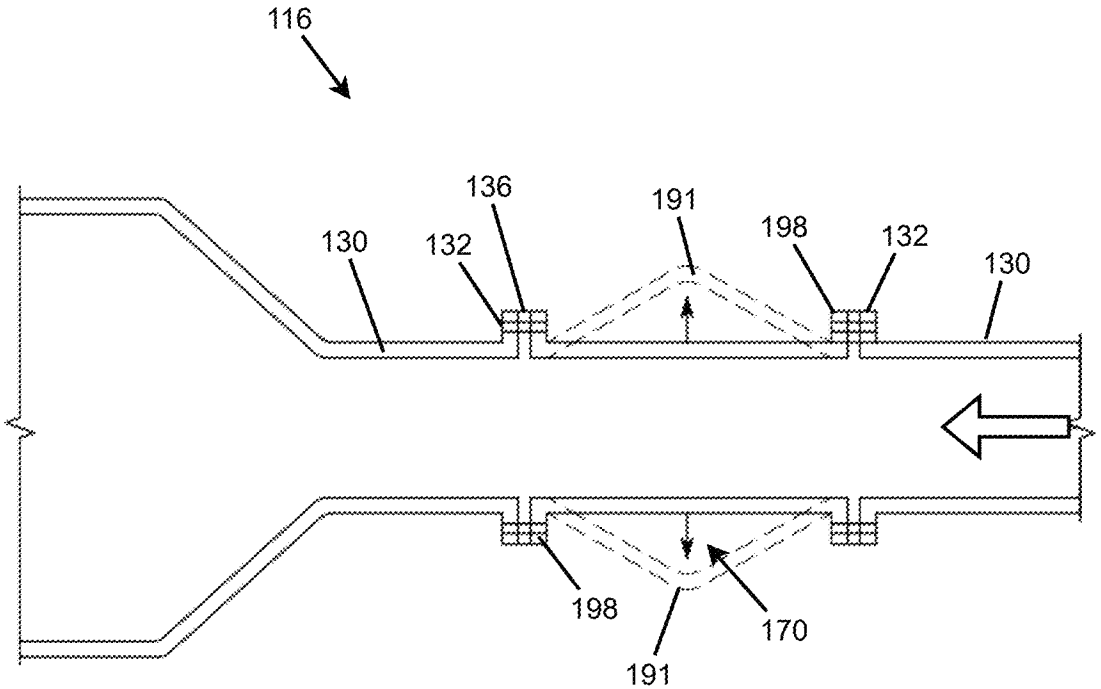
FIG. 7 is a top view of a trough with a deformable trough extension in accordance with an embodiment.

Referring to e.g., FIG. 4 and FIG. 7, the trough 100 comprises a trough extension 170 provided by a deformable bridge 190 (see FIGS. 9-10) secured at its upstream end to the trough 100 and at its downstream end to a rigid structure 130, providing a continuous channel for the stream to exit the trough 100. The deformable bridge 190 made of flexible allows the trough extension to remain secured to the trough when tilting. Use of a trough extension 170 comprising a deformable bridge 190 offers advantages, comprising easier maintenance and channel deformations easing the emptying process.

Figure 9:
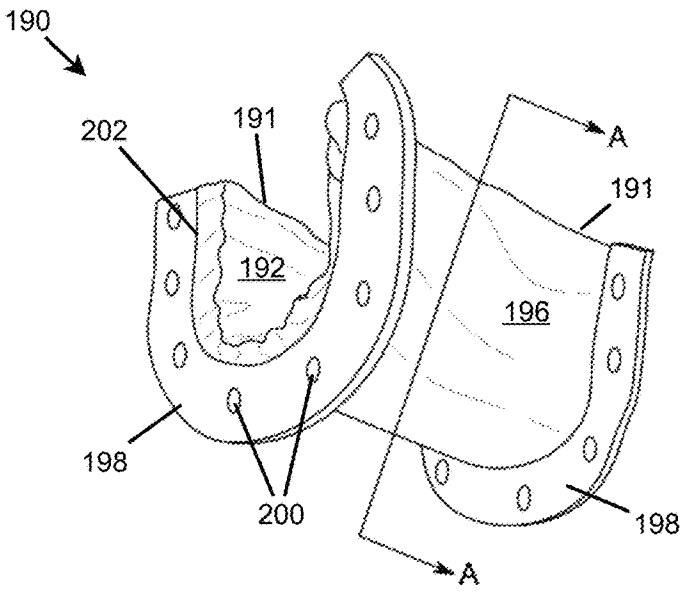
FIG. 9 is a perspective view of a trough extension in accordance with an embodiment.
Figure 10:
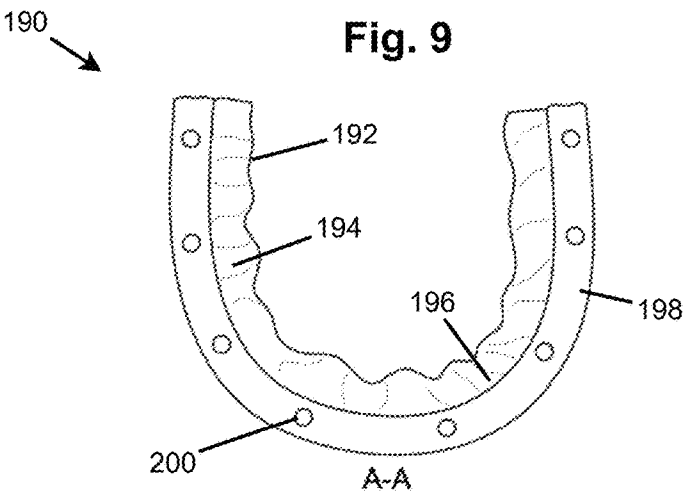
FIG. 10 is a cross-section view of the trough extension of FIG. 9 in accordance with an embodiment.

Referring additionally to FIGS. 9-10, the deformable bridge 190 is an assembly, from the metal contacting face and away, of a first layer 192 of a first fabric designed to be molten aluminum resistant, e.g., a fabric-coated H10B (trademark) textile manufactured by Pyrotek, a second layer 194 of an insulating material, e.g., a ceramic fiber insulating blanket, and a third layer 196 of a second fabric that provides mechanical characteristics (improved resistance) to the deformable bridge 190, comprising extra rigidity, e.g., a OS 1000/V5 (trademark) textile manufactured by Pyrotek.

The trough extension 170 comprises rigid flanges 198 at each end. The deformable bridge 190 has a U-shape between the flanges 198, with edges 191 at the extremities of the U-shape. The end edges 202 of the bridge 190 join with flanges 198 in an impermeable manner. The flanges 198 comprises holes 200 distributed over for mounting the deformable bridge 190 to the rigid structure 130 and the downstream end 114 of the trough 100.

Referring additionally to FIG. 7, in an exemplary installation of the trough extension 170, the trough extension 170 is secured at one end to, e.g., a rigid structure 130, ending with a similar flange and to the trough 100 at the other end. To mount one to the other, the flanges of the trough extension and the other structure are aligned with each other, with a gasket 136 mounted therebetween, and the flanges being secured to each other through e.g. bolts extending through the aligned holes 200, compressing the gaskets 136 in-between at each channel junctions.

According to other embodiments, even if considered less efficient, the trough 100 may be adapted to be emptied through alternative structure with temporarily sequestered molten aluminum.

Figure 12:
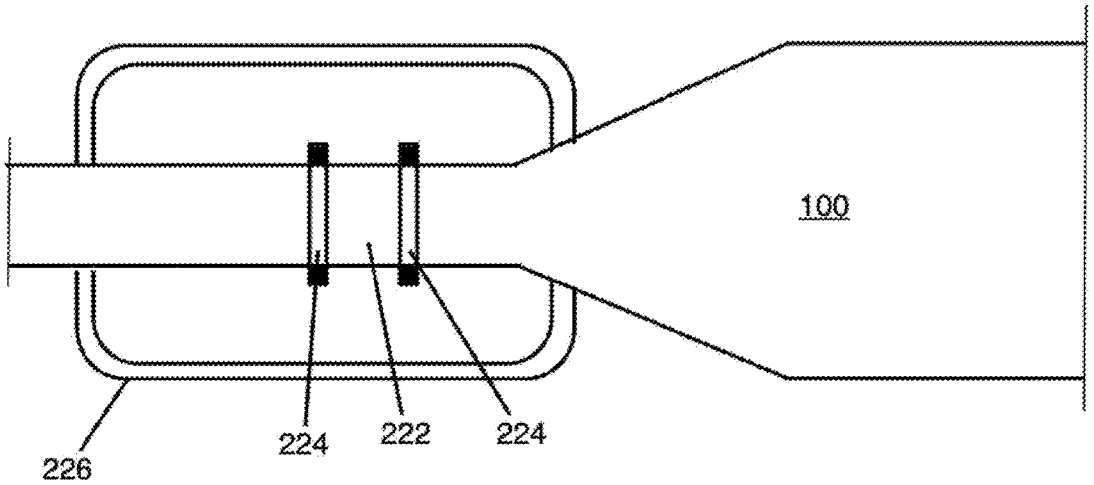
FIG. 12 is a top view of a trough having a removable V-shaped trough section installed over a pan in accordance with an embodiment.
Figure 13:
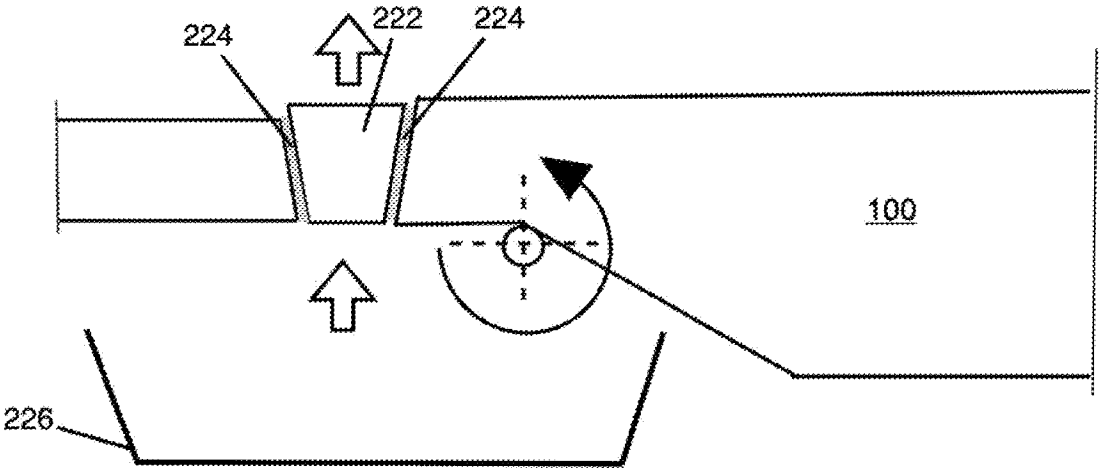
FIG. 13 is a side view of the trough and pan of FIG. 12.

For instance, referring to FIG. 12 and FIG. 13, the trough 100 may connect to a removable V-shaped trough section 222 (of e.g., sides have about 15-degree angles) mounted with gaskets 224. The trough section 222 may be removed before tilting the trough 100, preparing the trough 100 to be emptied. A pan 226 is placed below, about the opening resulting from the trough section 222 being removed. The trough 100 is after tilted, emptying its content into the pan 226.

Figure 14:
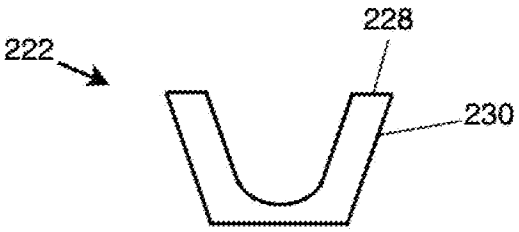
FIG. 14 is a transversal view of a trough in accordance with an embodiment.

Referring to FIG. 14, the trough section 222 comprises an interior part 228 composed of a refractory liner, and an exterior part 230 composed of a steel shell.

Figure 15:
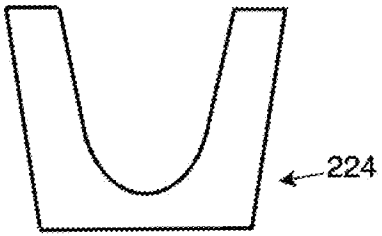
FIG. 15 is a transversal view of a gasket in accordance with an embodiment.

Referring to FIG. 15, the gaskets 224 have a similar shape, of e.g., 1 inch of thickness. Exemplary gaskets 224 are composed of material G-2 (trademark) manufactured by Pyrotek.

Figure 16:
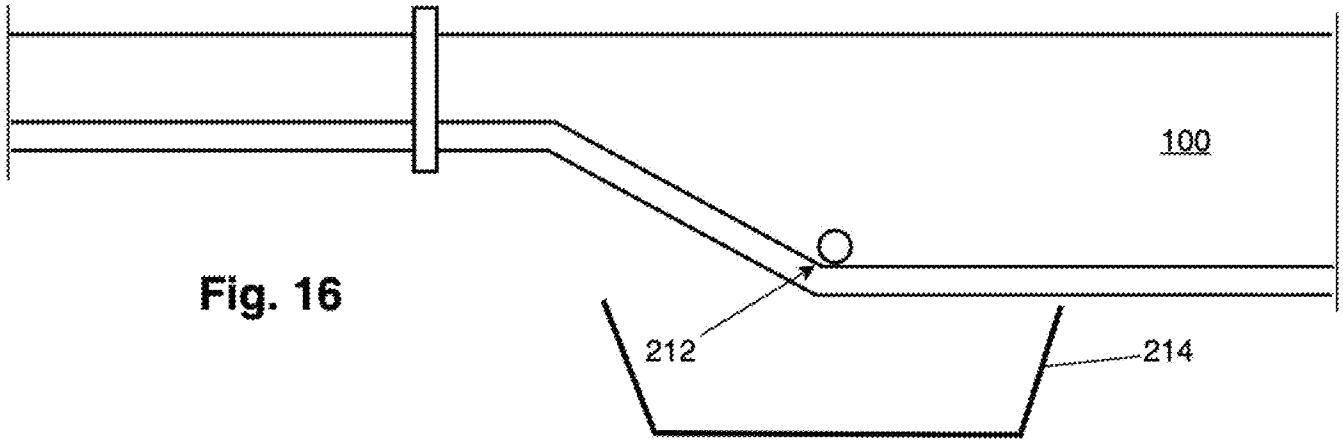
FIG. 16 is a side view of a trough comprising a draining hole and a pan in accordance with another embodiment.

For instance, referring to FIG. 16, a trough 100 may be equipped with a draining hole 212 with a removable plug allowing to force the molten aluminum to flow from the trough 100 to a pan 214 placed below.

While preferred embodiments have been described above and illustrated in the accompanying drawings, it will be evident to those skilled in the art that modifications may be made without departing from this disclosure. Such modifications are considered as possible variants comprised in the scope of the disclosure.

The invention claimed is:

1. A trough assembly for degassing molten aluminum, comprising:

a trough having a passage extending from an upstream end to a downstream end, the passage being adapted for a stream of the molten aluminum to be conveyed thereby, the passage having a central section in-between the upstream end and the downstream end, the passage having a width and a depth with at least one of the width and the depth the thereof increasing between its upstream end and the central section thereby slowing down the stream, means for heating the central section of the trough; and a plurality of agitators movable between i) an elevated position in which they are adapted to be distant from the stream and ii) a lowered position in which the agitators are adapted to extend across the stream, wherein the trough comprises pinions extending outwardly about a first one of the upstream and downstream ends thereof, and wherein the trough is tiltable around the pinions when raising a second one of the upstream and downstream ends thereof.

2. The trough assembly of claim 1, wherein, in a first position in which the stream flows, the passage deepens from the upstream end to the central section.

3. The trough assembly of claim 1, wherein, in a first position in which the stream flows, the passage widens from the upstream end to the central section.

4. The trough assembly of claim 1, wherein, in a first position in which the stream flows, the passage shallows from the central section to the downstream end.

5. The trough assembly of claim 1, wherein, in a first position in which the stream flows, the passage narrows from the upstream end to the central section.

6. The trough assembly of claim 1, wherein the means for heating the trough comprises a heating bed on which is adapted to be laid the trough.

7. The trough assembly of claim 6, wherein the heating bed comprises refractory material with electric heating elements set therein, wherein the trough and the heating bed have marrying shape adapted for optimizing contact between the trough and the heating bed.

8. The trough assembly of claim 1, wherein the trough comprises a V-shaped trough section adapted for releasably sequestering the molten aluminum in the central section thereof.

9. The trough assembly of claim 1, wherein the trough comprises a central longitudinal axis, wherein the agitators are aligned with and distributed along the central longitudinal axis in the central section of the trough.

10. The trough assembly of claim 1, wherein the trough comprises side walls delimiting width of the passage, wherein the side walls are no closer than 85% of a reference value, and are no farther than 115% of the reference value, wherein the reference value is determined to be an average distance between any two neighbor ones of the agitators.

11. A trough assembly for degassing molten aluminum, comprising:

a trough having a passage extending from an upstream end to a downstream end, the passage being adapted for a stream of the molten aluminum to be conveyed thereby, the passage having a central section in-between the upstream end and the downstream end, the passage having a width and a depth with at least one of the width and the depth thereof increasing between its upstream end and the central section thereby slowing down the stream, means for heating the central section of the trough; and a plurality of agitators moveable between i) an elevated position in which they are adapted to be distant from the stream and ii) a lowered position in which the agitators are adapted to extend across the stream, wherein the trough is movable between a first position adapted for the stream to flow through and a second position adapted to empty the trough in which a first one of the ends of the trough is raised relative to a second one of the ends of the trough, wherein the trough is exerted a rotation of at least 10 degrees between its first position and its second position.

12. The trough assembly of claim 11, wherein the trough has a floor that, in the first position, has a slope that reaches an angle of at most 15 degrees between the central section and the downstream end thereof.

13. A trough assembly for degassing molten aluminum, comprising:

a trough having a passage extending from an upstream end to a downstream end, the passage being adapted for a stream of the molten aluminum to be conveyed thereby, the passage having a central section in-between the upstream end and the downstream end, the passage having a width and a depth with at least one of the width and the depth thereof increasing between its upstream end and the central section thereby slowing down the stream, means for heating the central section of the trough; and a plurality of agitators moveable between i) an elevated position in which they are adapted to be distant from the stream and ii) a lowered position in which the agitators are adapted to extend across the stream, wherein the trough assembly further comprises a deformable trough extension being flexible, the deformable trough extension comprising opposed ends with a bridge in-between for the stream, the bridge of the deformable trough extension changing shape as the opposed ends are moved relative to one another.

14. The trough assembly of claim 13, wherein the deformable extension comprises two ends with a first end of the deformable trough extension being secured to one end of the trough, and a second end of the deformable trough extension adapted to be fixedly secured to another device.

15. The trough assembly of claim 13, wherein the deformable trough extension comprises a pair of rigid flanges, and a textile-composed bridge joining the rigid flanges.

16. The trough assembly of claim 15, wherein the trough is movable between a first position adapted for the stream to flow through and a second position adapted to empty the trough in which a first one of the ends of the trough is raised relative to a second one of the ends of the trough, wherein the bridge of the deformable trough extension comprises two edges, wherein the edges thereof between the flanges are adapted to move away from one another as the trough is moved in the second position.

17. The trough assembly of claim 15, wherein the bridge of the deformable trough extension comprises a first layer made of refractory textile, a second layer made of an insulating layer, and a third layer being mechanically more resistant than the first layer.

* * * * *